United States Patent [19]

Tugwood et al.

[11] Patent Number: 4,479,785

[45] Date of Patent: Oct. 30, 1984

[54] LEG ROPE FOR A SURFBOARD

[76] Inventors: Ian D. Tugwood; Geoffrey D. Tugwood, both of 7 Gunyah Pl., Avalon, New South Wales, Australia

[21] Appl. No.: 400,152

[22] Filed: Jul. 20, 1982

[51] Int. Cl.[3] ..... A63C 15/06

[52] U.S. Cl. ..... 441/75; 403/78

[58] Field of Search ..... 441/75, 84; 119/96; 440/34; 403/164, 165, 78; 59/9, 95; 119/106, 109

[56] References Cited

U.S. PATENT DOCUMENTS

| | | | |
|---|---|---|---|
| 1,002,875 | 9/1911 | Schnoor | 59/95 |
| 1,468,579 | 9/1923 | Scanlon et al. | 59/95 |
| 2,708,999 | 5/1955 | Rush | 59/95 |
| 2,911,947 | 11/1959 | Kramer | 119/96 |
| 2,994,300 | 8/1961 | Grahling | 119/96 |
| 3,104,650 | 9/1963 | Grahling | 119/96 |
| 4,041,562 | 8/1977 | Nealy | 441/75 |

*Primary Examiner*—Trygve M. Blix
*Assistant Examiner*—Thomas J. Brahan
*Attorney, Agent, or Firm*—Emory L. Groff, Jr.

[57] ABSTRACT

A leg rope to secure a surf board to a surfer includes a cuff to engage around the leg of a surfer, an anchoring member to secure the leg rope to a surf board, the cuff being connected to the anchoring member by a helically coiled extensible member fixed at one end to the anchoring member and at its other end to a swivel which is connected to the cuff, and a catch on the swivel to prevent relative rotational movement between the swivel parts while the helically coiled member is under tension.

3 Claims, 9 Drawing Figures

~Fig 1~
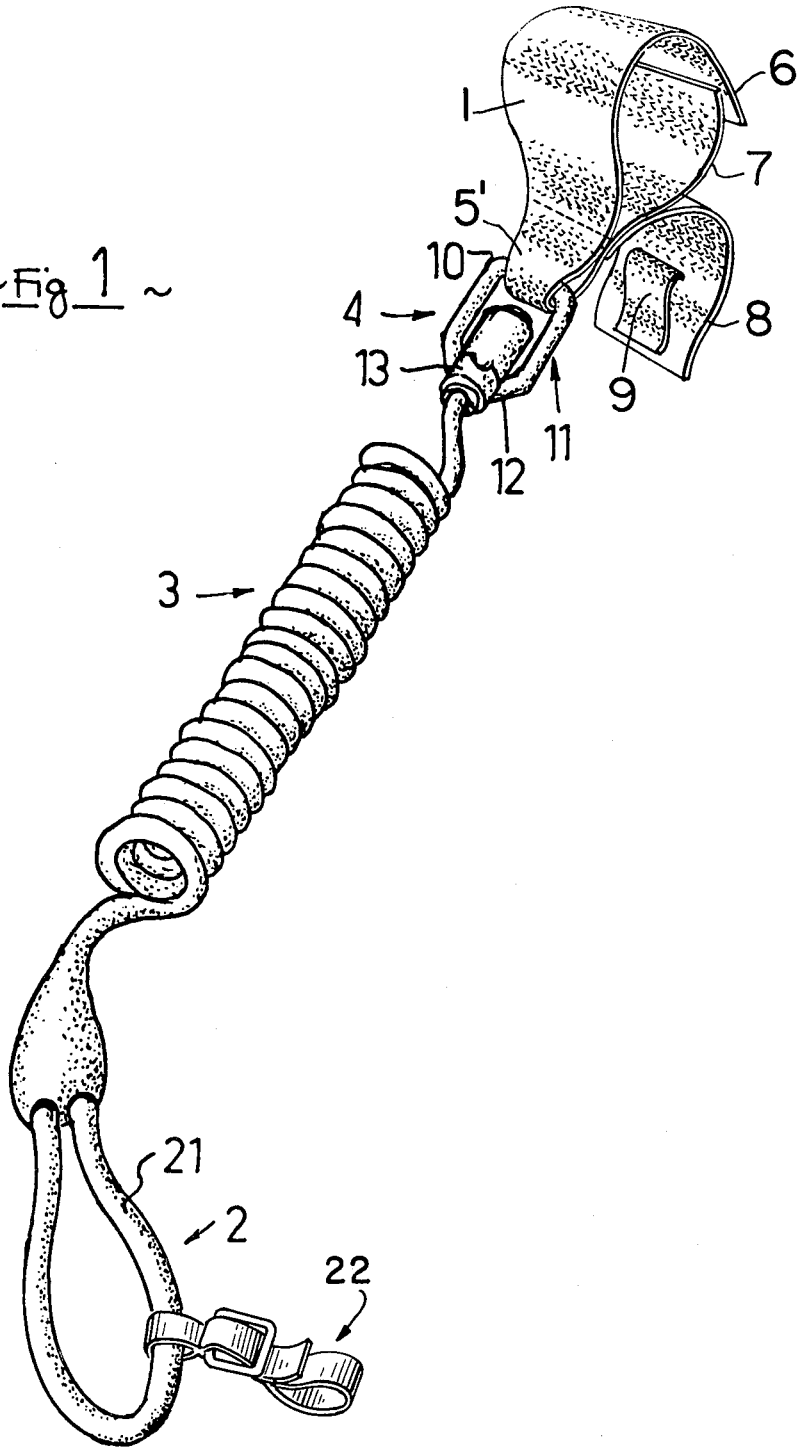

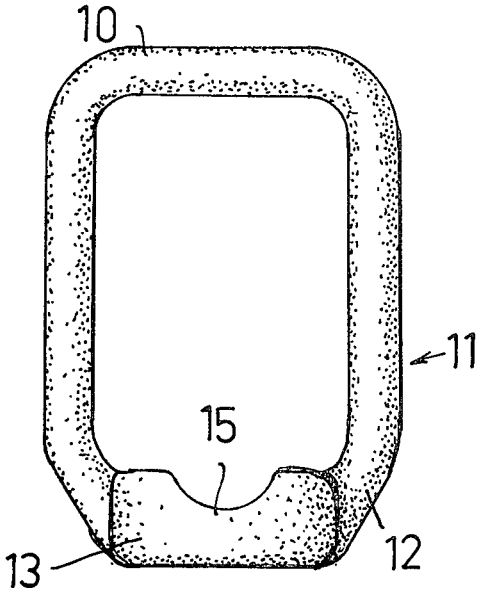
~Fig. 2~
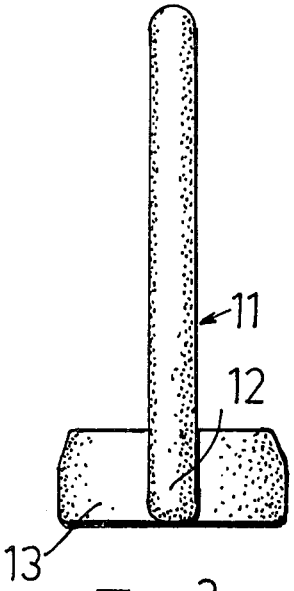
~Fig. 3~
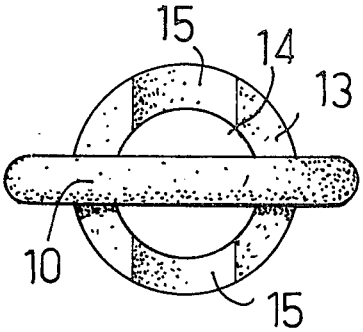
~Fig. 4~
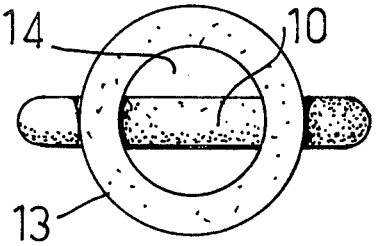
~Fig. 5~

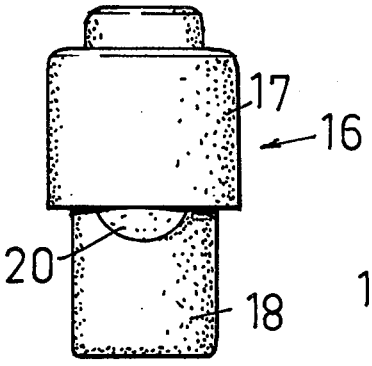
~Fig. 6~
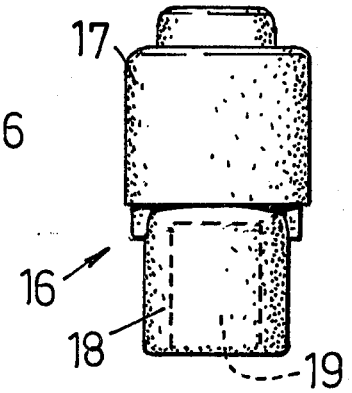
~Fig. 7~
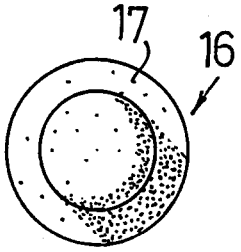
~Fig. 8~
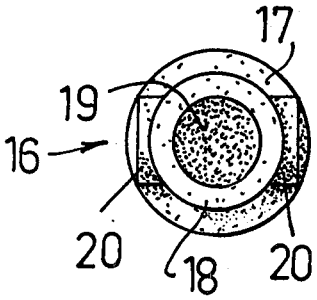
~Fig. 9~

LEG ROPE FOR A SURFBOARD

This invention is concerned primarily, but not exclusively, with a leg rope for tethering a surfboard to a surf board rider. Leg ropes are used to enable a board rider to retrieve a surf board once the rider has become separated, either intentionally or un-intentionally, from his surf board.

Leg ropes now in use are usually lengths of rope of a suitable type coupled at one end to a plug in the surfboard or an eye of some type formed in the surfboard at the time of manufacture or subsequently. The other end of the rope is coupled to a leg band adapted to be secured around one leg of the board rider.

There have been several features of leg ropes patented, as for example the leg rope of U.S. Pat. No. 4,044,415 which provides a leg rope having two sections each with a different stretch capability, and that of U.S. Pat. No. 3,931,656 which provides an inner member of set length surrounded by an outer member which is resilient and of a lesser length, and that of U.S. Pat. Nos. 4,285,083 and 3,802,011 which provide yet other features.

None of the foregoing patents deal in a comprehensive manner with the problems of tangling of the leg rope when in use. If the leg rope becomes entangled with the foot or leg of a surf board rider it can cause discomfort and in some instances there can be physical danger to the board rider.

The present invention overcomes the above problem by providing an article for use primarily as a leg rope which will retain a shortened condition until longitudinal load is placed upon it and which will, when relieved of the load, return to the shortened condition. More specifically, the present invention provides an extensible coupling means comprising a first attachment means connected to a second attachment means by a helically coiled member, the first attachment means is adapted for releasable connection to an anchoring means and the second attachment means is adapted for connection to a member to be anchored to the anchoring means through the coupling means, the coiled member is made of an elongated resilient element which because of its resilience and its coiled form opposes any force applied to stretch the coiled element from a rest condition and because of the same characteristics returns the coiled member to the rest configuration upon the release of any stretching force, and a swivel member linking one end of the coiled member to the first attachment means, said swivel member including catch means to prevent swivel action when a stretching force is applied to coiled member.

The present invention in a preferred form as applied to a surf board leg rope will now be described with reference to the accompanying drawings in which:

FIG. 1 is a perspective view of a complete leg rope,

FIG. 2 is a front view of a bail portion of the swivel used in the leg rope of FIG. 1, FIG. 3 is an edge view of the bail of FIG 2, FIG. 4 is a plan view of the bail of FIG. 2 when viewed in the direction of the arrow 4 of FIG. 2, FIG. 5 is an inverted plan view of the bail of FIG. 2 when viewed in the direction of the arrow 5 of FIG. 2, FIG. 6 is a front view of the spindle which co-operates with the bail of FIG. 2, FIG. 7 is an edge view of the spindle of FIG. 6, FIG. 8 is a plan view of the spindle of FIG. 6 when viewed in the direction of the arrow 8 of FIG. 6 and FIG. 9 is an inverted plan view of the spindle of FIG. 6 when viewed in the direction of the arrow 9 of FIG. 6.

The present invention has been achieved after a great deal of experimentation. At first glance the proposal that the cuff 1 of the leg rope be coupled to the board hitch 2 by a coiled member 3 to allow stretching and ensure compactness and tidiness of the rope when not stretched appears obvious. However, it has been found that the coiled member 3 mis-coiled under certain circumstances of recoiling after the release of the stretching force.

This phenomena is well known and is often experienced in cords, such as coiled telephone cords, whereby the handpiece is coupled to the instrument body. The mis-coiling occurs on the removal of the stretching force applied to a coiled member when one or more coils turn back upon it or themsleves forming a loop or loops which interrupts the recoiling of the member in a regular helical manner. When several mis-coilings occur the result is an unsightly mass of twisted coils referred to often as a "bunch of grapes". It is not always easy to restore the cord to a regular coiled configuration after the formation of a "bunch of grapes".

Applicants have found that with a coiled member for a leg rope the formation of a bunch of grapes tangle is allied to the ability of a coiled member 3 to rotate at one of its ends relative to its other end during the application of the elongating force, as can occur when a simple swivel is used to couple the coiled member to a leg cuff. This ability is a characterising feature of a conventional leg rope where the leg rope assembly includes at least one multi-directional swivel allowing the conventional rope to rotate and thus avoid the formation of rope shortening knots and twists as the rope is twisted and turned in the activity of surf board riding. There is thus a basic differences between the conventional leg rope assembly and the leg rope assembly proposed by this invention. The differences are that with the conventional leg rope twists and turns in the leg rope are to be avoided, whereas with the proposed leg rope an organised pre-disposition to coil up into a helically wound member is an essential, and a conventional swivel cannot be used.

The present invention overcomes the above problem by means of a special swivel member 4 linking one end of the coiled member 3 to the cuff 1 which prevents relative rotational motion between the inter-connected swivel elements when the coiled member 3 is under tension but allows such motion in the direction dictated by the recoil memory of the coiled member 1 when the tension is released.

A more detailed description of the various members now follows. The cuff 1 is made from a band in which is formed a loop 5'. One free end 6 of the band 5 is intended, when the cuff is in use, to overlie the other end 7 and a flap 8, fixed to the band 5 adjacent the end 7, overlies the band end 6. There is a patch of gripping fabric attached to the underside of the flap 8 and to the exposed outer face of the band end 6. The gripping fabric is well known by the trademark "Velcro". A finger grip 9 is provided to assist in the release of the Velcro connection, i.e. by an upward and backward pull on the finger grip 9 the gripping patches of material are disengaged. If desired Velcro can be placed between the underface of the end 6 and the outer face of the end 7 of the band to provide a connection supplementary to that between the end 6 and the flap 8.

The loop 5' is engaged around one end 10 of a rectangular ring 11 forming part of a bail of the swivel member 4. At the opposite end 12 of the ring 11 there is a boss 13 through which there is a hole 14 and on the inner face of the boss 13 through which the hole 14 exits there are two diametrically opposed grooves 15 of curved cross-sectional contour.

The other part of the swivel 4 is a spindle 16 including a head portion 17 and a reduced diameter shank 18. There is a hole 19 into the end of the shank 18 to accept one end of the coiled member 2. There are two diametrically opposed lugs 20 on the head 17 positioned and shaped to engage in the grooves 15. It is to be noted that the corners where the lugs 20 abut the head 17 and the corners at the tops of the grooves 15 are radiused. It is also to be noted that the contours of the lugs and the grooves are conducive to the lugs 20 riding up out of the grooves 15 when a torque is applied to the spindle 18, as by the stored up stresses in the coiled member 3 (resulting from the extension of coiled member 3) after the removal of a extending force.

The coiled member 2 is made of tubular urethane helically coiled in known manner and preferably incorporates a longitudinal non-extensible central element (not shown) to limit the maximum length to which the member 2 can be extended. Solid urethane can also be used for the coiled member 3. One end of the member 2 is fixed in the hole 19 and the other end of the member 2 is fixed in a moulding operation to a loop 21 of solid urethane which forms a member for attachment to a surf board. In the present embodiment the attachment is by a belt and buckle combination 22 but is not limited thereto.

Several other forms of swivel can be used to achieve the desired operation of the leg rope assembly, for example there can be a pin or pins on the spindle 10 to engage in a hole or holes in the boss 13, in much the same way as the grooves 15 and the lugs 20 co-operate in the illustrated embodiment. With the pin and hole arrangement there is preferably biassing means to urge the pins from the holes once the coil straightening force is released thereby allowing recoiling to occur. The swivel could incorporate a frictional arrangement whereby the release of the coil straightening force results in the lessening of the frictional engagement between portion of the spindle and the bail to the point where the memory of the coiled member, arising out of the stresses induced in the coiled member as a result of the application of an elongating force, causes it to recoil.

We claim:

1. A leg rope to connect a surf board to a surfer, said rope comprising a helically coiled extensible member made of resilient material, an anchoring member fixed to one end of the coiled member whereby the extensible member can be anchored to a surf board, a cuff to engage around the leg of a surfer, a swivel connecting the cuff to the other end of the extensible member, said swivel including two components, the first component comprising a body having a hole therethrough, radially disposed grooves across a face of the body in a plane at right angles to the axis of said hole through the body, an arched member extending over the grooved body face with the ends of the arched member fixed to the body and the cuff fixed to the arched member, the second component comprising a swivel including a shank with one end of the shank fixed to the other end of the coiled member, said shank located in the hole through the body of the first swivel component with abundant clearance therebetween, a head on the shank located between the arched member and the grooved face of the first swivel component, radially disposed lugs on the underface of the head on the shank engageable in the radial grooves of the first swivel component, said grooves and lugs being respectively concave and convex and complementarily dimensioned and substantially semi-circular with radiused edges where the grooves meet the face of said body of the first swivel component said grooves and lugs being dimensioned as to prevent relative rotational movements between said components when a tension force is applied and permits relative rotational movements between said components when the tension force is released.

2. A leg rope as claimed in claim 1 wherein said helically coiled extensible member is made from a length of rod material coiled and set in helical form.

3. A leg rope as claimed in claim 2 wherein said helically coiled member is made from urethane.

* * * * *